United States Patent [19]

Haug et al.

[11] Patent Number: 4,787,189

[45] Date of Patent: Nov. 29, 1988

[54] BUILDING BLOCKS

[75] Inventors: Erik M. Haug, Gosnells; Erling G. Haug, Inglewood, both of Australia

[73] Assignee: Baldina Pty. Ltd., Booragoon, Australia

[21] Appl. No.: 767,281

[22] PCT Filed: Nov. 8, 1984

[86] PCT No.: PCT/AU84/00230

§ 371 Date: Aug. 19, 1985

§ 102(e) Date: Aug. 19, 1985

[87] PCT Pub. No.: WO85/02216

PCT Pub. Date: May 23, 1985

[30] Foreign Application Priority Data

Nov. 8, 1983 [AU] Australia ..... PG2252

[51] Int. Cl.[4] ..... E04B 2/00

[52] U.S. Cl. ..... 52/415; 52/592; 52/603; 52/606

[58] Field of Search ..... 52/592, 436, 439, 309.7, 52/438, 441, 603–607, 417, 419, 595, 415, 442, 437

[56] References Cited

U.S. PATENT DOCUMENTS

| | | | |
|---|---|---|---|
| 960,217 | 5/1910 | Dodds | 52/436 |
| 3,369,335 | 2/1968 | Smith | 52/270 |
| 3,503,165 | 3/1970 | Hardt | 52/607 X |
| 4,038,798 | 8/1977 | Sachs | 52/309.7 |
| 4,388,361 | 6/1983 | Vassalli | 52/595 X |

FOREIGN PATENT DOCUMENTS

| | | | |
|---|---|---|---|
| 545350 | 3/1956 | Belgium | 52/595 |
| 575796 | 4/1933 | Fed. Rep. of Germany | 52/589 |
| 67675 | 12/1958 | France | 52/436 |
| 463062 | 11/1968 | Switzerland | 52/603 |
| 600772 | 4/1948 | United Kingdom | 52/595 |

*Primary Examiner*—John E. Murtagh
*Assistant Examiner*—Andrew Joseph Rudy
*Attorney, Agent, or Firm*—Harness, Dickey & Pierce

[57] ABSTRACT

A building construction comprised of blocks of substantially rectangular prismatic configuration. The first pair of opposite edges of the blocks are each formed with a first tongue and a first groove of complementary configuration extending in parallel relationship along each edge wherein the first tongue of one edge is opposite the first groove of the other edge. Each of said first pair of edges is formed with a land portion extending between the sides of said edge and the adjacent first tongue or groove. The height of said first tongue above said land portion is greater than the depth of the first groove below said land portion such that on a pair of blocks abutting whereby the first tongue of one edge is snugly received within the first groove of the other edge of another block, the opposing land portions of the blocks are spaced from each other to receive an adhesive for fixing the blocks to each other. The second pair of edges are formed whereby one edge has a second tongue extending along its edge and the portion of the one edge to each side of the second tongue is formed with raised land portions. The other edge of said second pair of edges is formed with a second groove of complementary configuration to said second tongue wherein the height of the second tongue above the land portions is equal to the depth of the second groove.

19 Claims, 2 Drawing Sheets

BUILDING BLOCKS

BACKGROUND OF THE INVENTION

This invention relates to building blocks and in particular building blocks formed with mating tongue in grooves along their adjacent edges.

It has been a problem with tongue in groove blocks that while the tongue in groove provide for longitudinal alignment of the blocks during their laying, when the blocks are laid one upon the other the loading between the blocks is accommodated by the bonding composition between the blocks and while that bonding composition is setting the vertical alignment of the blocks can vary.

It is an object of this invention to provide building blocks whereby on the blocks being laid they are positively supported by each other to prevent any misalignment while the bonding composition between the blocks sets.

SUMMARY OF THE INVENTION

In one form the invention resides in a building block of substantially rectangular prismatic configuration wherein the first pair of opposite edges are each formed with a first tongue and a first groove of complementary configuration extending in parallel relationship along each edge wherein the first tongue of one edge is opposite the first groove of the other edge, each of said first pair of edges being formed with a land portion extending between the sides of said edge and the adjacent first tongue or groove, the height of said first tongue above said land portion being greater than the depth of the first groove below said land portion such that on a pair of blocks abutting whereby the first tongue of one edge is snugly received within the first groove of the other edge of another block, the opposing land portions of the blocks are spaced from each other, the second pair of edges being formed whereby one edge has a second tongue extending along its edge and the portions of the one edge to each side of the second tongue being formed with raised land portions, and the other edge of said second pair of edges is formed with a second groove of complementary configuration to said second tongue wherein the height of the second tongue above the land is equal to the depth of the second groove.

According to a preferred feature of the invention the blocks are associated with an elongate base strip having a length greater than at least two blocks and having a planar undersurface and an upper surface having a complementary configuration to the other edge of said second pair of edges to said block, the land portions of said base strip being formed with rebates.

According to a further preferred feature of the invention the blocks are associated with an elongate capping strip having a length of at least equal to two blocks and having an undersurface of complementary configuration to the one edge of the said pair of edges of said blocks.

According to a further preferred feature of the invention the blocks are formed with a set of spaced passageways extending between the second pair of edges.

According to a further preferred feature of the invention the passageways through the block are symmetrically located at equally spaced intervals to each side of the central axis of the block extending between said other edges of the block.

According to a further preferred feature of the invention the set of passageways to each side of the central axis are spaced from each other a distance equal to the spacing between the end most passageways of a pair of abutting blocks, when in position.

The invention will be more fully understood in the light of the following description of one specific embodiment. The description is made with reference to the accompanying drawings of which:

DESCRIPTION OF THE PREFERRED EMBODIMENTS

Figure 1:
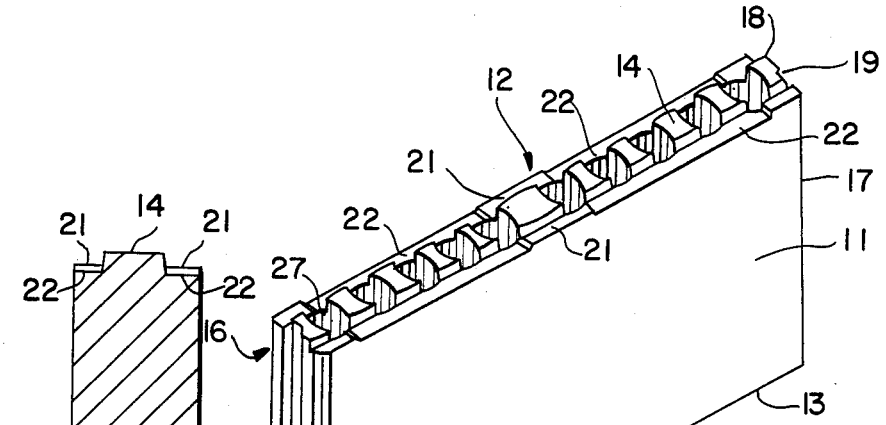
FIG. 1 is an isometric upright view of a block according to the embodiment.
Figure 2:
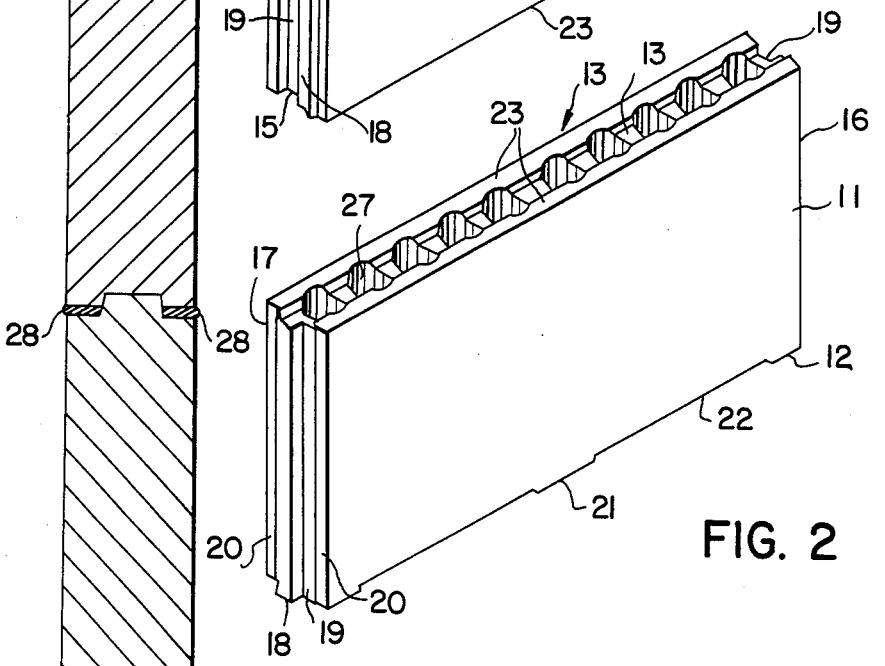
FIG. 2 is an isometric inverted of a block according to the embodiment.
Figure 3:
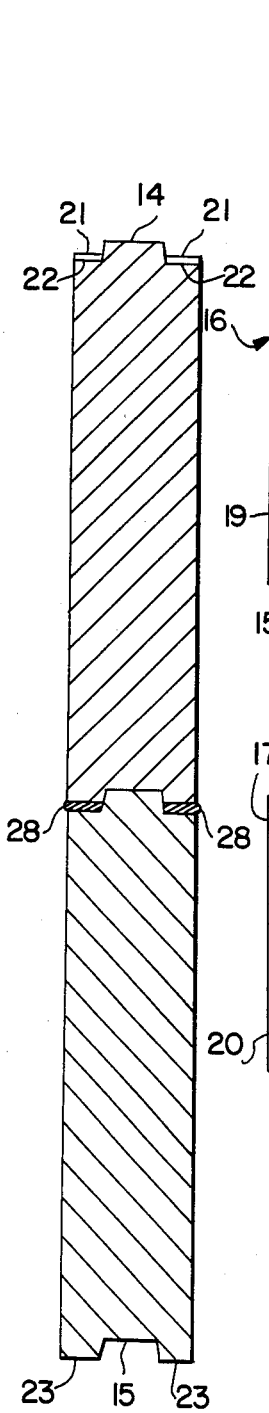
FIG. 3 is a sectional elevation of a pair of abutting blocks.
Figure 4:
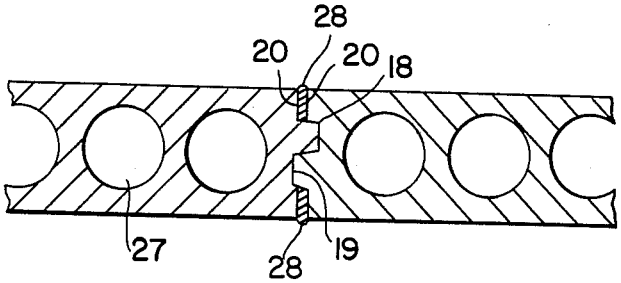
FIG. 4 is a plan sectional view of an interconnection between a pair of blocks.

The embodiment is directed towards a building block 11 of substantially rectangular prismatic configuration having an upper and lower edge 12 and 13 respectively formed with a complementary tongue 14 and groove 15 respectively. The upright ends 16 and 17 of the block are each formed with a tongue and a groove 18 and 19 respectively. The tongue and groove 18 and 19 are of complementary configuration and the tongue and groove at one end are complementary in profile to the tongue and groove at the other end whereby on the blocks being located in abutting end to end relationship with other similar blocks the tongue 18 of one block will be received in the groove 19 of the other block and the tongue 18 of the other block will be received in the groove 19 of the one block. As a result of this relationship the one end of a block will be received in the any end of a similar block. The depth of the groove 19 is less than the height of the tongue 18 such that on a pair of blocks being located in abutting relationship with each other the land portions 20 to each side of the tongue and groove 18 and 19 of one block are spaced from the land portions 20 of the abutting block. This space can be filled with a bonding composition 28 either prior to the laying of the blocks or on the blocks being laid. Due to the snug engagement between the tongue and groove at one end of one block with the tongue and groove of an end of an abutting block the blocks are accurately located in end to end relationship and any excess bonding composition between the land portions 20 is squeezed to the exterior of the block to be wiped off. If the bonding composition is located on the land portions 20 before the blocks are located in position such bonding composition does not interfere with any snug engagement between the blocks 18 and 19 and does not affect the alignment between the blocks. As a result of such when the blocks are laid in end to end relationship the exterior faces of the blocks 11 form a substantially continuous co-planar surface.

The tongue 14 and groove 15 of the upper and lower faces 12 and 13 are of complementary configuration and the portions of the edge to each side of the tongue 14 is formed with a series of raised land portions 21 with recesses 22 between them. In laying the blocks the recesses 22 have a bonding composition applied thereto whereby the upper block is supported by the tongue and groove engagement between the blocks and by the land portions 21 of the lowermost block abutting with the underneath planar land portions 23 of the lower edge. Any excess bonding composition is forced to the exterior of the block to be wiped off. Since the bonding composition is only located in the recesses 22 there is no loading placed on that bonding composition and all loading between the blocks is accommodated between the tongue 13 and groove 14 and the land portions 21 and 23 of the opposed faces. As a result the blocks may be located in accurate alignment such that the exposed faces of the blocks form a substantially continuous coplanar surface.

Figures 5, 6:
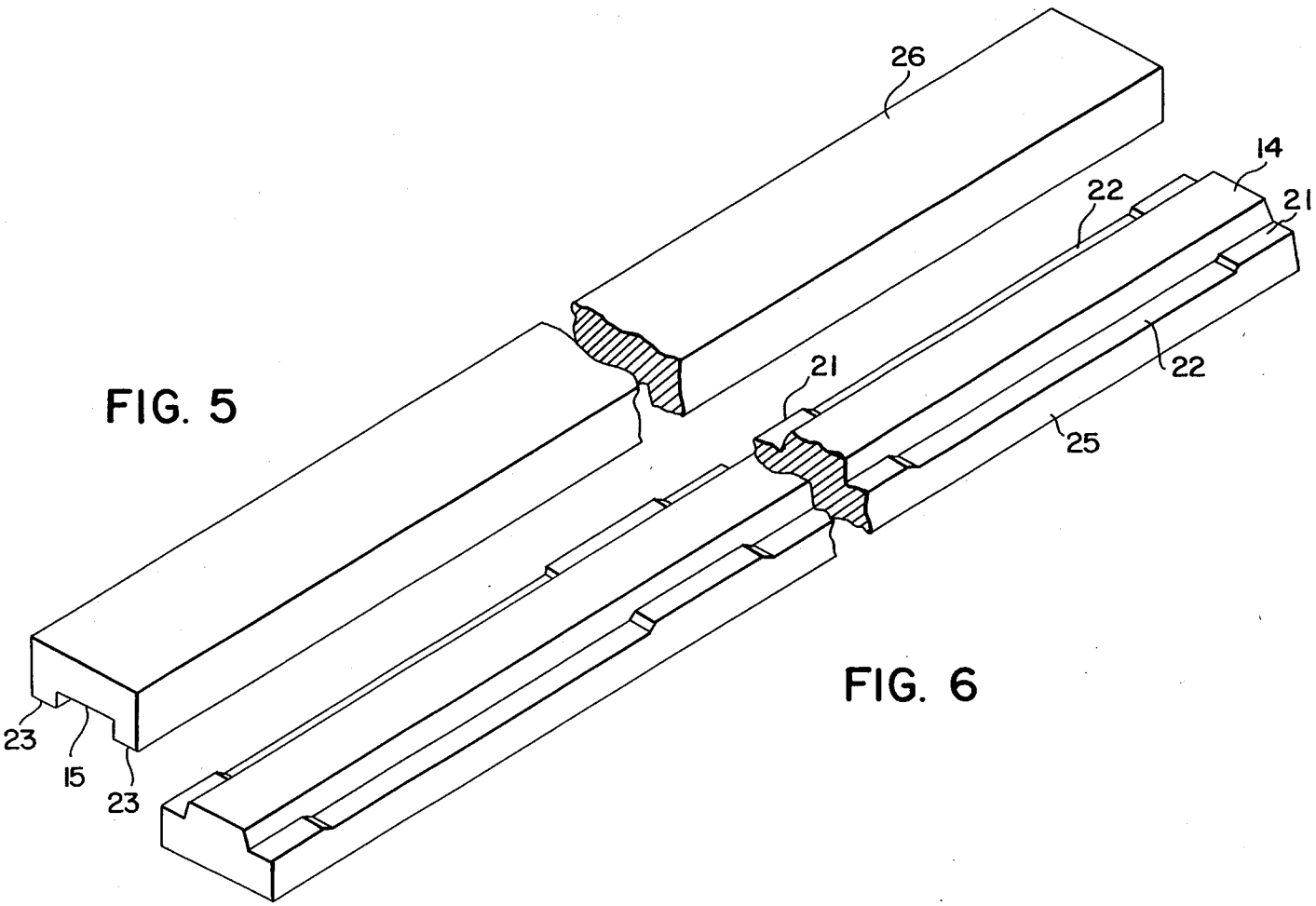
FIG. 5 is an isometric view of a capping strip used in the embodiment.
FIG. 6 is an isometric view of a base strip of the embodiment.

To facilitate the accurate location of the first course of blocks on a surface a base strip 25 (FIG. 6) is used which has a length in excess of at least two blocks. The base strip 25 is formed with an upstanding tongue 14 of complementary configuration to the tongue of the block 11 and is formed with raised land portions 21 to each side of the tongue 14 with recess portions 22 formed between this. As a result of the base strip 25 the first course of blocks may be accurately located over a surface to be maintained in accurate longitudinal alignments. In addition the base strip 25 serves in preventing any misalignment between the blocks as a result of undulations in the surface supporting the blocks.

The blocks are also associated with a capping strip 26 having a length in excess of at least two blocks and having an underneath surface of complementary configuration to the upper surface of the blocks 11 whereby the underneath surface is formed with a groove 15 of complementary configuration to the tongue 14 of the blocks 11 with a land portion 23 to each side thereof.

In order to reduce the mass of the blocks without affecting the loading capabilities of the blocks each of the blocks is formed with a series of passageways 27 extending between the upper and lower faces 14 and 15. The passageways comprise two sets of spaced passageways to each side of the central transverse axis of the block. At the spacing between each set corresponds to the spacing between the end most passageways of a pair of abutting blocks. As a result of this arrangement the passageways 27 of a pair of vertically located blocks will always be in alignment if the blocks are located directly one above the other or with one block stepped halfway along the length of the other as in conventional block laying practice. This communication between the passageways 27 facilitates the installation of services such as electrical conduits, water pipes and the like in the walls without the necessity to cut into the walls or chase the conduits or water pipes into the exterior surface of the wall.

In another form the land portions may comprise raised button like protrusions formed to each side of the tongue or rib like protrusions.

As a result of the embodiment a building block is provided which can be easily and accurately located in position with the minimum of expertise, to produce a wall which is in both vertical and horizontal alignment and which has adequate sound proofing and fire resistant qualities. The embodiment particularly lends itself to gypsum blocks which are used in internal wall construction in residential housing and in office partitioning installations.

It should be appreciated that the scope of the present invention need not be limited to the particular scope of the embodiment described above.

The claims defining the invention are as follows:

1. A building construction comprised of blocks of substantially rectangular prismatic configuration wherein the first pair of opposite edges of each block are each formed with a first tongue and a first groove of complementary configuration extending in parallel relationship along each edge wherein the first tongue of one edge is opposite the first groove of the other edge, each of said first pair of edges being formed with a land portion extending between sides of said edge and the adjacent first tongue or groove, the height of said first tongue above said land portion being greater than the depth of the first groove below said land portion such that on a pair of blocks abutting whereby the first tongue of one edge is snugly received within the first groove of the other edge of another block,, the opposing land portions of the blocks are spaced from each other and a gap is formed between said land portions outwardly of said first tongue and said groove, the second pair of edges being formed whereby one edge has a second tongue extending along its edge and the portion of the one edge to each side of the second tongue being formed with raised land portions, and the other edge of said second pair of edges is formed with a second groove of complementary configuration to said second tongue wherein the height of the second tongue above the land portions is equal to the depth of the second groove, and a bonding adhesive filling solely the gap between said land portions for affixing said blocks to each other.

2. A building block as claimed at claim 1 wherein the blocks are associated with an elongate base strip having a length greater than at least two blocks and having a planar undersurface and an upper surface having a complementary configuration to the other edge of said second pair of edges to said block, the land portions of said base strip being formed with rebates.

3. A building block as claimed at claim 1 wherein the blocks are associated with an elongate capping strip having a length at least equal to two blocks and having an undersurface of complementary configuration to the one edge of the said pair of edges of said blocks.

4. A building block as claimed at claim 1 wherein the blocks are formed with a set of spaced passageways extending between the second pair of edges.

5. A building block as claimed at claim 4 wherein the passageways through the block are symmetrically located at equally spaced intervals to each side of the central axis extending between said other edges of the block.

6. A building block as claimed at claim 5 wherein the set of passageways to each side of the central axis are spaced from each other a distance equal to the spacing between the end-most passageways of a pair of abutting blocks, when in position.

7. A building block as set forth in claim 5 wherein the upper and lower edges are formed with raised, spaced apart land portions adapted to engage each other when the building blocks are supported one upon the other and defining interposed gaps to receive a bonding adhesive.

8. A building block as claimed at claim 2 wherein the blocks are associated with an elongate capping strip having a length at least equal to two blocks and having an undersurface of complementary configuration to the one edge of the said pair of edges of said blocks.

9. A building block as claimed at claim 8, wherein the blocks are formed with a set of spaced passageways extending between the second pair of edges.

10. A building block as claimed at claim 2 wherein the blocks are formed with a set of spaced passageways extending between the second pair of edges.

11. A building block as claimed at claim 3 wherein the blocks are formed with a set of spaced passageways extending between the second pair of edges.

12. A building block as claimed at claim 11 wherein the passageways through the block are symmetrically located at equally spaced intervals to each side of the central axis extending between said other edges of the block.

13. A building block as claimed at claim 9 wherein the passageways through the block are symmetrically located at equally spaced intervals to each side of the central axis extending between said other edges of the block.

14. A building block as claimed at claim 10 wherein the passageways through the block are symmetrically located at equally spaced intervals to each side of the central axis extending between said other edges of the block.

15. A building block as claimed at claim 14 wherein the set of passageways to each side of the central axis are spaced from each other a distance equal to the spacing between the end-most passageways of a pair of abutting blocks, when in position.

16. A building block as claimed at claim 12 wherein the set of passageways to each side of the central axis are spaced from each other a distance equal to the spacing between the end-most passageways of a pair of abutting blocks, when in position.

17. A building block as claimed at claim 13 wherein the set of passageways to each side of the central axis are spaced from each other a distance equal to the spacing between the end-most passageways of a pair of abutting blocks, when in position.

18. A building block as set forth in claim 1 wherein the upper and lower edges are formed with raised, spaced apart land portions adapted to engage each other when the building blocks are supported one upon the other and defining interposed gaps to receive a bonding adhesive.

19. A building block as set forth in claim 2 wherein the upper and lower edges are formed with raised, spaced apart land portions adapted to engage each other when the building blocks are supported one upon the other and defining interposed gaps to receive a bonding adhesive.

* * * * *